US011164732B2

(12) United States Patent
Shichi

(10) Patent No.: US 11,164,732 B2
(45) Date of Patent: Nov. 2, 2021

(54) MASS SPECTROMETRY DETECTION DEVICE AND MASS SPECTROMETER

(71) Applicant: SHIMADZU CORPORATION, Kyoto (JP)

(72) Inventor: Hideharu Shichi, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/294,186

(22) Filed: Mar. 6, 2019

(65) Prior Publication Data

US 2019/0362954 A1 Nov. 28, 2019

(30) Foreign Application Priority Data

May 24, 2018 (JP) ..... JP2018-099701

(51) Int. Cl.
*H01J 49/02* (2006.01)
*H01J 49/08* (2006.01)

(52) U.S. Cl.
CPC ..... *H01J 49/025* (2013.01); *H01J 49/08* (2013.01)

(58) Field of Classification Search
CPC ..... H01J 49/025; H01J 49/08
See application file for complete search history.

(56) References Cited

U.S. PATENT DOCUMENTS 2,959,676 A * 11/1960 Burk ..... H01J 49/36 250/293
5,202,561 A * 4/1993 Giessmann ..... G01T 1/28 250/281
5,347,126 A * 9/1994 Krauss ..... H01J 49/40 250/287
2002/0112508 A1* 8/2002 Ohba ..... B29C 35/10 65/425
2011/0147578 A1* 6/2011 Schultz ..... H01J 49/142 250/282
2015/0162174 A1* 6/2015 Badiei ..... H01J 49/0009 250/288
2015/0219607 A1* 8/2015 Fujita ..... H01J 49/025 250/288
2015/0325420 A1* 11/2015 Collings ..... H01J 49/025 250/282

(Continued)

FOREIGN PATENT DOCUMENTS

JP 2012-122871 A 6/2012
WO 9401206 A 1/1994

OTHER PUBLICATIONS

Communication dated Oct. 16, 2019 from the European Patent Office in application No. 19175252.6.

*Primary Examiner* — Sean M Luck
(74) *Attorney, Agent, or Firm* — Sughrue Mion, PLLC

(57) ABSTRACT

The mass spectrometer includes an ionizer, a mass separator, a detection device, a storage, and a controller. The detection device includes a detector and an electron introducer. The electrons from the electron introducer are introduced into the detector. In addition to an analysis operation, the mass spectrometer performs an operation to determine a voltage applied to the detector. At this point, electrons are introduced from the electron introducer to the detector. In the case that a detection value from the detector is less than a threshold, the controller can determine that a defect such as aging is generated in the detector.

6 Claims, 5 Drawing Sheets

(56) References Cited

U.S. PATENT DOCUMENTS

| | | | | |
|---|---|---|---|---|
| 2016/0035449 | A1* | 2/2016 | Putterman | H05H 15/00 376/108 |
| 2016/0133448 | A1* | 5/2016 | Silivra | H01J 49/0009 250/252.1 |
| 2016/0181077 | A1* | 6/2016 | Ouyang | H01J 49/0422 250/282 |
| 2017/0062198 | A1* | 3/2017 | Sanford | H01J 49/0027 |

* cited by examiner

MASS SPECTROMETRY DETECTION DEVICE AND MASS SPECTROMETER

CROSS REFERENCE TO RELATED APPLICATIONS

This application claims priority to Japanese patent Application No. 2018-099701 filed on May 24, 2018, the entire disclosure of which is incorporated by reference herein.

BACKGROUND OF THE INVENTION

Field of the Invention

The present invention relates to a mass spectrometry detection device that detects ions mass-separated by a mass separator and a mass spectrometer including the mass spectrometry detection device.

Description of the Related Art

The mass spectrometer includes an ionizer that ionizes a sample, a mass separator that separates ions, and a detection unit that detects the ions discharged from the mass separator.

For example, the detection unit includes a conversion dynode and an electron multiplier (detector). The ions from the mass separator are converted into electrons by the conversion dynode. The electrons are detected by the electron multiplier. A predetermined voltage is applied to the electron multiplier. For this reason, the electrons are multiplied and detected in the electron multiplier.

In this way, the electrons are detected in the detection unit. A mass spectrum is produced based on a detection signal from the detection unit (electron multiplier) (for example, JP-A-2012-122871).

In this way, the detection signal can sufficiently be obtained from the electron multiplier by applying the predetermined voltage to the electron multiplier, and the mass spectrum can be produced based on the detection signal.

SUMMARY OF THE INVENTION

In the conventional mass spectrometer, the voltage applied to the electron multiplier is determined based on a detection intensity value (peak value) indicated by the mass spectrum in performing analysis operation. For example, in the case that the detection intensity value of the mass spectrum is small, a user checks the detection intensity value, and adjusts the applied voltage such that the detection intensity value is increased.

When the applied voltage is determined for the electron multiplier in this way, whether a cause to decrease the detection intensity value of the mass spectrum is an individual difference or aging of the electron multiplier or a defect of the ionizer or the mass separator cannot be determined. Specifically, even if the individual differences or the aging is generated in the electron multiplier, or even if the defect is generated in the ionizer or the mass separator, the detection intensity value of the mass spectrum is decreased in a similar way, so that the cause cannot be specified.

The present invention has been made in view of the above circumstances, and an object of the present invention is to provide a mass spectrometry detection device and a mass spectrometer, each being able to surely determine the defect of the detector.

(1) The present invention provides a mass spectrometry detection device that detects ions mass-separated by a mass separator. The mass spectrometry detection device includes a detector and an electron introducer. The detector detects electrons. The electron introducer is provided separately from the mass separator, and introduces electrons into the detector.

With this configuration, in the mass spectrometry detection device, the electrons from the electron introducer are introduced into the detector. The defect of the detector can surely be determined when the defect is determined based on intensity (detected value) of the detection signal from the detector at that time.

For example, the electrons are introduced from the electron introducer to the detector, and the intensity of the detection signal from the detector at that time is less than a threshold. At this point, a determination that the defect such as the aging is generated in the detector can be made.

As described above, the defect of the detector can surely be determined in the mass spectrometry detection device of the present invention.

(2) The electron introducer may generate thermoelectrons and introduce the thermoelectrons to the detector.

With this configuration, the defect of the detector can surely be determined with a simple configuration in which the thermoelectrons are generated.

(3) The electron introducer may generate electrons by field emission and introduce the electrons into the detector.

With this configuration, the defect of the detector can surely be determined with a simple configuration in which the electrons are generated by the field emission.

(4) The electron introducer may generate electrons by a photoelectric effect, and introduce the electrons into the detector.

With this configuration, the defect of the detector can surely be determined with a simple configuration in which the electrons are generated by the photoelectric effect.

(5) The present invention provides a mass spectrometer including the mass spectrometry detection device and a mass separator. The mass separator mass-separates ions generated from a sample, and introduces the ions into the mass spectrometry detection device.

With this configuration, the defect of the detector can surely be determined in the mass spectrometer. In the case that the defect is generated in the mass separator (a mechanism except for the detector), the defect can be determined.

For example, in the case that the defect can be determined to be not generated in the detector, and in the case that a detection intensity value of a mass spectrum becomes small, a determination that the defect is generated in the mass separator (the mechanism except for the detector) can be made.

(6) The mass spectrometer may further include an applied voltage determination unit. The applied voltage determination unit determines a voltage applied to the detector during mass spectrometry based on a detection value when the electrons introduced by the electron introducer are detected by the detector.

With this configuration, in the case that the detection value of the detector is decreased due to the defect such as the aging in the detector, the applied voltage determination unit can properly determine the applied voltage. A proper detection value can be output from the detector by applying the applied voltage to the detector.

According to the present invention, in the mass spectrometry detection device, the electrons from the electron introducer are introduced into the detector. The defect of the detector can surely be determined when the defect is determined based on intensity of the detection signal from the detector at that time.

DETAILED DESCRIPTION OF THE PREFERRED EMBODIMENTS

1. Entire Configuration of Mass Spectrometer

Figure 1:
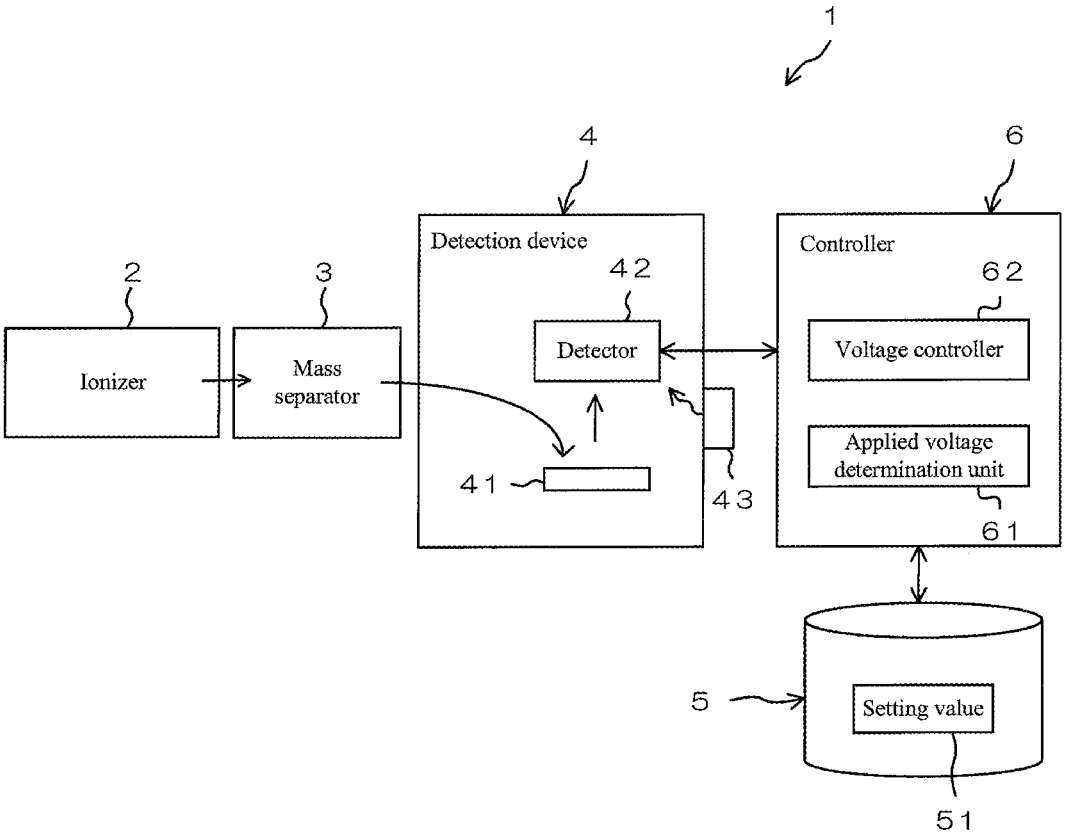
FIG. 1 is a schematic diagram illustrating a configuration example of a mass spectrometer according to a first embodiment of the present invention.

FIG. 1 is a schematic diagram illustrating a configuration example of a mass spectrometer 1 according to a first embodiment of the present invention.

The mass spectrometer 1 includes an ionizer 2, a mass separator 3, a detection device (mass spectrometry detection device) 4, a storage 5, and a controller 6.

The ionizer 2 ionizes a target sample. For example, the ionizer 2 is a MALDI (matrix-assisted laser desorption ionization) ion source. A sample plate to which a sample adheres and an irradiator (not illustrated) that emits a laser beam toward the sample are provided in the ionizer. Another ion source such as electrospray ionization (ESI) may be used as the ionizer 2.

The mass separator 3 performs mass separation of ions generated from the sample. For example, the mass separator 3 is a three-dimensional quadrupole ion trap. An ion trap other than the three-dimensional quadrupole ion trap may be used as the mass separator 3.

The detection device 4 detects mass-separated ions. The detection device 4 includes a conversion dynode 41, a detector 42, and an electron introducer 43.

The conversion dynode 41 converts ions into electrons. For example, the detector 42 is an electron multiplier. The detector 42 multiplies and detects electrons from the conversion dynode 41.

The electron introducer 43 generates electrons, and introduces the electrons to the detector 42.

The storage 5 is constructed with a ROM (Read Only Memory), a RAM (Random Access Memory), and a hard disk. A setting value 51 is stored in the storage 5. The setting value 51 is information about voltage applied to the detector 42.

For example, the controller 6 includes a CPU (Central Processing Unit). The detector 42 and the storage 5 are electrically connected to the controller 6. The CPU executes a program, which allows the controller 6 to function as an applied voltage determination unit 61 and a voltage controller 62.

The applied voltage determination unit 61 determines an applied voltage to the detector 42 based on a detection signal (detection value) from the detector 42. The determined applied voltage is stored in the storage 5 as the setting value 51.

The voltage controller 62 reads the setting value 51 of the storage 5, and applies the voltage to the detector 42 with a voltage value indicated by the setting value 51.

In the case that the sample is analyzed using the mass spectrometer 1, the sample is set in the ionizer 2. The sample is ionized using the ionizer 2. The obtained ions are introduced into the mass separator 3 to perform the mass separation. The mass-separated ions are introduced into the detection device 4.

The ions introduced into the detection device 4 are converted into the electrons by the conversion dynode 41. The electrons from the conversion dynode 41 are introduced into the detector 42. The voltage is applied to the detector 42 with a predetermined voltage value. For this reason, the detector 42 detects the electrons while the electrons are multiplied. The controller 6 produces a mass spectrum based on the detection signal from the detector 42.

In addition to the above analysis operation, the mass spectrometer 1 performs an operation to determine the voltage applied to the detector 42. At this point, as will be described later, the electrons are generated by the electron introducer 43 and the electrons are introduced into the detector 42.

The electron introducer 43 is not limited to a configuration described later, but a member that is normally provided in the mass spectrometer 1 may be used as the electron introducer 43. For example, a vacuum gauge provided in the mass spectrometer 1 may be used as the electron introducer 43. In this case, a relative position between the vacuum gauge and the detector 42 is adjusted such that the electrons generated by the vacuum gauge are introduced into the detector 42. In this case, preferably the vacuum gauge is turned off during the analysis operation.

2. Configuration of Detection Device

Figure 2:
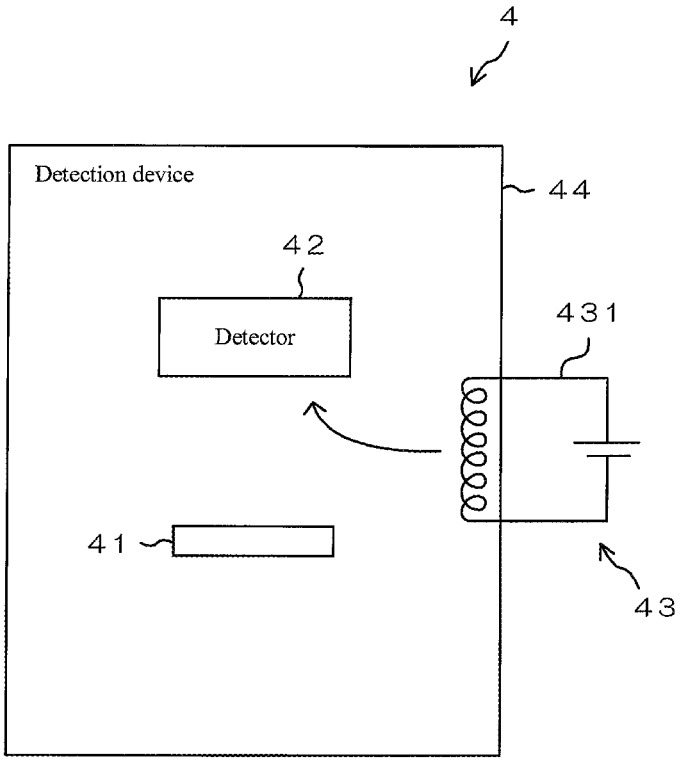
FIG. 2 is a schematic diagram illustrating a configuration example of a detection device of the mass spectrometer in FIG. 1.

FIG. 2 is a schematic diagram illustrating a configuration example of the detection device 4.

In the example of FIG. 2, a filament 431 is provided as the electron introducer 43 in the detection device 4. Specifically, the filament 431 is provided in a housing 44 formed in a hollow shape. A part of the filament 431 is disposed in the housing 44. The portion of the filament 431 located in the housing 44 is disposed near the detector 42. Current is supplied to the filament 431 with a predetermined current value.

3. Operation to Determine Applied Voltage

Figure 3:
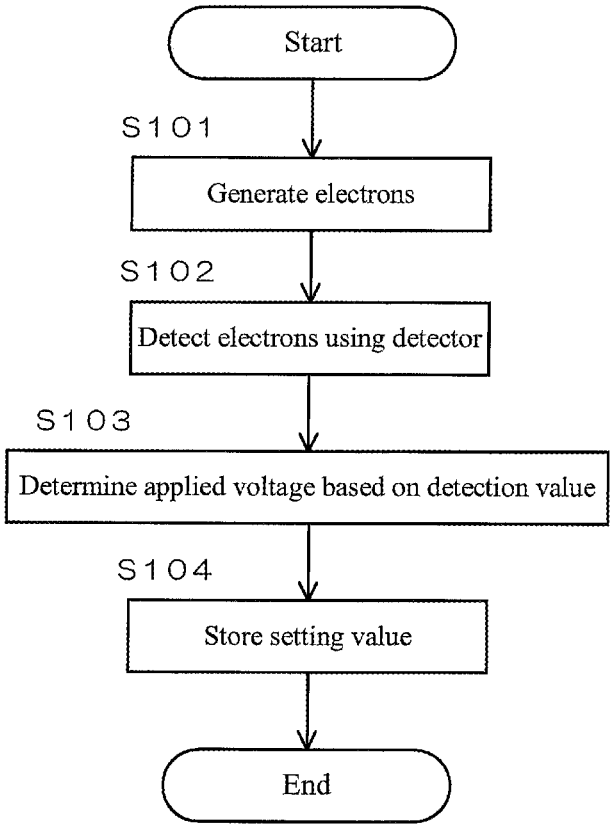
FIG. 3 is a flowchart illustrating an operation procedure in determining a voltage applied to a detector.

FIG. 3 is a flowchart illustrating an operation procedure in determining the voltage applied to the detector 42.

In addition to the above analysis operation, the mass spectrometer 1 performs the operation (applied voltage determination operation) to determine the voltage applied to the detector 42. For example, this operation is performed prior to the analysis operation.

Specifically, in the example of FIG. 3, the current is supplied to the filament 431 with a predetermined current value. Thermoelectrons are generated from the filament 431 by thermionic emission (step S101). The thermoelectrons generated by the filament 431 are introduced into the detector 42. The detector 42 detects the thermoelectrons (electrons) from the filament 431 (step S102), and outputs the detection signal.

Based on the detection signal (detection value) from the detector 42, the applied voltage determination unit 61 determines the voltage applied to the detector 42 during the mass spectrometry (step S103). For example, in the case that the detection signal (detection value) from the detector 42 is less than a threshold, the applied voltage determination unit 61 determines the voltage applied to the detector 42 such that the detection signal (detection value) is greater than or equal to the threshold.

At this point, in the case that the detection signal (detection value) from the detector 42 is less than the threshold, the controller 6 can determine that a defect such as aging is generated in the detector 42. The threshold used to determine that the defect is generated in the detector 42 may be a value different from the threshold used to determine the voltage applied to the detector 42.

The applied voltage determined by the applied voltage determination unit 61 is stored in the storage 5 as the setting value 51 (step S104).

In this way, the operation (applied voltage determination operation) to determine the voltage applied to the detector 42 is completed.

When the mass spectrometer 1 performs the mass spectrometry, the voltage controller 62 reads the setting value 51 from the storage 5, and applies the voltage having the value indicated by the setting value 51 to the detector 42. Consequently, the detection value of the detection signal from the detector 42 becomes proper. A sufficient intensity value (peak value) can be obtained in the mass spectrum produced by the mass spectrometer 1.

The determination that the defect is generated in the mass separator 3 (the mass separator 3 or the ionizer 2) can be made in the case that the detection intensity value of the mass spectrum produced by the mass spectrometer 1 becomes small.

3. Function and Effect (1) In the first embodiment, in the mass spectrometer 1, the detection device 4 includes the detector 42 and the electron introducer 43 as illustrated in FIG. 1. The electrons from the electron introducer 43 are introduced into the detector 42.

Specifically, in addition to the analysis operation, the mass spectrometer 1 performs the operation (applied voltage determination operation) to determine the voltage applied to the detector 42.

At this point, the electrons are introduced from the electron introducer 43 to the detector 42. In the case that the detection signal (detection value) from the detector 42 is less than the threshold, the controller 6 can determine that the defect such as the aging is generated in the detector 42.

That is, the mass spectrometer 1 can surely determine the defect of the detector 42.

In the case that the defect is generated in the mass separator 3, the mass spectrometer 1 can determine the defect. For example, in the case that the applied voltage having the value indicated by the setting value 51 is applied to the detector 42, and in the case that the detection intensity value of the mass spectrum becomes small, the determination that the defect is generated in the mass separator 3 (the mass separator 3 or the ionizer 2) can be made.

(2) In the present embodiment, the electron introducer 43 includes the filament 431 as illustrated in FIG. 2. In the detection device 4, the current is supplied to the filament 431 with the predetermined current value, and the thermoelectrons are generated from the filament 431 by the thermionic emission. The thermoelectrons generated by the filament 431 are introduced into the detector 42.

As described above, in the mass spectrometer 1, the defect of the detector 42 can surely be determined with a simple configuration in which the filament 431 is provided in the detection device 4 to generate the thermoelectrons.

(3) In the present embodiment, the mass spectrometer 1 includes the controller 6. The controller 6 also functions as the applied voltage determination unit 61. The applied voltage determination unit 61 determines the voltage applied to the detector 42 during the mass spectrometry based on the detection value when the electrons introduced by the electron introducer 43 (filament 431) are detected by the detector 42.

For this reason, in the case that the detection value of the detector 42 is decreased due to the defect such as the aging in the detector 42, the applied voltage determination unit 61 can properly determine the applied voltage. The proper detection value can be output from the detector 42 by applying the applied voltage to the detector 42.

4. Second Embodiment

Other embodiments of the present invention will be described below with reference to FIGS. 4 and 5. The configuration similar to that of the first embodiment is denoted by the reference numeral similar to that of the first embodiment, and the description is omitted.

Figure 4:
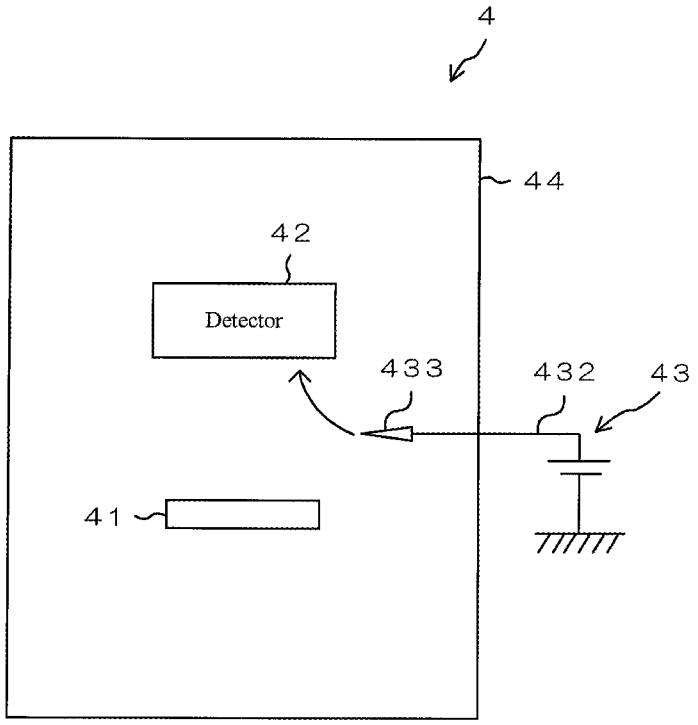
FIG. 4 is a schematic diagram illustrating a configuration example of a detection device of a mass spectrometer according to a second embodiment of the present invention.

FIG. 4 is a schematic diagram illustrating a configuration example of a detection device 4 of a mass spectrometer 1 according to a second embodiment of the present invention.

In the second embodiment, an electrode 433 connected to wirings 432 and 432 is provided as the electron introducer 43 in the detection device 4.

A part of the wiring 432 is disposed in the housing 44. The electrode 433 is provided at a leading end of the wiring 432. The electrode 433 is disposed near the detector 42.

In the example of FIG. 4, a high voltage is applied to the electrode 433 through the wiring 432. Consequently, electrons are generated at the electrode 433 by field emission. The electrons generated at the electrode 433 are introduced into the detector 42.

In the second embodiment, in the detection device 4, the electrons are generated at the electrode 433 by the field emission, and the electrons are introduced into the detector 42.

For this reason, the defect of the detector 42 can surely be determined with a simple configuration in which the wiring 432 and the electrode 433 are provided in the detection device 4 to generate the electrons by the field emission.

A switching time between an on-state in which the electrons are generated and an off-state in which the electrons are not generated can be shortened because of the configuration in which the wiring 432 and the electrode 433 are provided in the detection device 4 to generate the electrons by the field emission.

5. Third Embodiment

Figure 5:
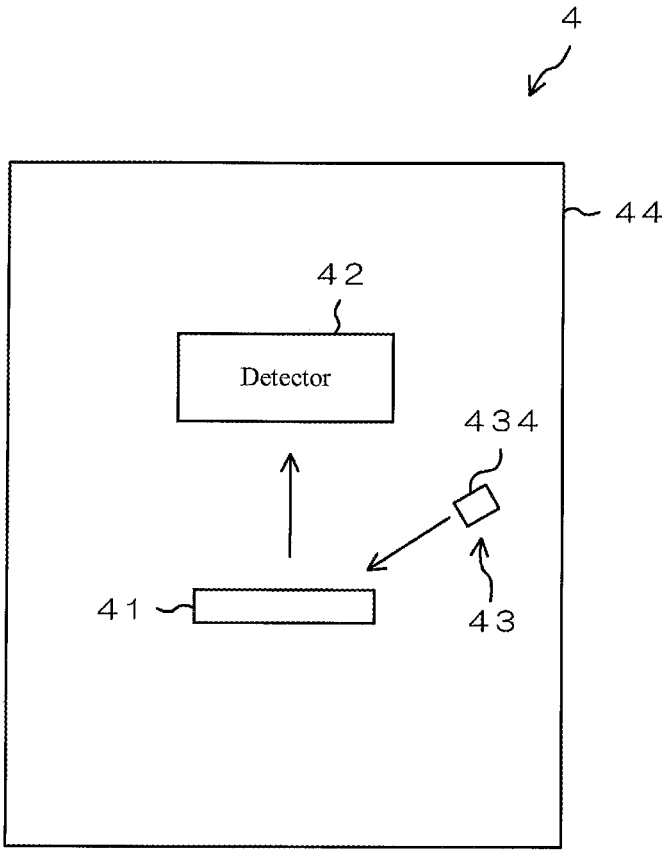
FIG. 5 is a schematic diagram illustrating a configuration example of a detection device of a mass spectrometer according to a third embodiment of the present invention.

FIG. 5 is a schematic diagram illustrating a configuration example of a detection device 4 of a mass spectrometer 1 according to a third embodiment of the present invention.

In the third embodiment, a light source 434 is provided as the electron introducer 43 in the detection device 4.

For example, the light source 434 is an ultraviolet LED, and is disposed in the housing 44.

In the example of FIG. 5, the conversion dynode 41 is irradiated with light emitted from the light source 434. Consequently, the electrons are generated in the conversion dynode 41 by a photoelectric effect. The electrons generated by the conversion dynode 41 are introduced into the detector 42. In the light source 434, the electrons may be generated by irradiating a metal component except for the conversion dynode 41 with light.

As described above, in the third embodiment, in the detection device 4, the electrons are generated by the photoelectric effect, and the electrons are introduced into the detector 42.

For this reason, the defect of the detector 42 can surely be determined with a simple configuration in which the light source 434 is provided in the detection device 4 to generate the electrons by the photoelectric effect.

The light source 434 may be provided outside the housing 44, and a window plate may be provided in the housing 44. The light from the light source 434 disposed outside the housing 44 may be incident on the housing 44 through the window plate, and the conversion dynode 41 may be irradiated with the light.

Consequently, the light source 434 can be disposed outside the housing 44.

Instead of the light source 434, an ion source may be provided near the conversion dynode 41. In this case, the electrons are generated by converting the ions generated by the ion source using the conversion dynode 41. The electrons can be introduced into the detector 42.

What is claimed is:

1. A mass spectrometer comprising:

an ionizer that is configured to ionize a sample to generate sample ions;

a mass separator that is configured to mass-separate the sample ions to produce mass-separated ions;

a detector that is configured to detect electrons; and an electron introducer that is provided separately from the mass separator and is configured to introduce electrons that are not converted from the mass separated ions and are not converted from ions passing through the mass separator directly into the detector without passing through the mass separator.

2. The mass spectrometry detection device according to claim 1, wherein the electron introducer is configured to generate thermoelectrons and introduce the thermoelectrons into the detector.

3. The mass spectrometry detection device according to claim 1, wherein the electron introducer is configured to generate electrons by field emission and introduce the electrons into the detector.

4. The mass spectrometry detection device according to claim 1, wherein the electron introducer is configured to generate electrons by a photoelectric effect and introduces the electrons into the detector.

5. The mass spectrometer according to claim 1, further comprising an applied voltage determination unit that is configured to determine a voltage applied to the detector during mass spectrometry, based on a detection value when the electrons introduced by the electron introducer are detected by the detector.

6. The mass spectrometry detection device according to claim 1, wherein electron introducer is provided on the outside of a housing that houses the detector.

* * * * *